United States Patent [19]

Kinsaul

[11] Patent Number: 4,779,361

[45] Date of Patent: Oct. 25, 1988

[54] FLEX LIMITING SHOE SOLE

[76] Inventor: Sam Kinsaul, 713 Oakhill Rd., Mobile, Ala. 36609

[21] Appl. No.: 76,960

[22] Filed: Jul. 23, 1987

[51] Int. Cl.[4] ..... A43B 13/12; A43B 13/00

[52] U.S. Cl. ..... 36/102; 36/30 R

[58] Field of Search ..... 36/33, 102, 30 R, 11.5, 36/44

[56] References Cited

U.S. PATENT DOCUMENTS

| | | | |
|---|---|---|---|
| 981,154 | 1/1911 | Austin | 36/30 |
| 1,733,733 | 10/1929 | Hess | 36/30 |
| 1,785,410 | 5/1966 | Gilkerson | 36/2.5 |
| 1,976,389 | 10/1934 | Everston | 36/30 |
| 2,053,502 | 9/1936 | Tarlow | 36/30 R |
| 2,124,819 | 7/1938 | Halloran | 36/30 |
| 2,126,077 | 8/1938 | Youngberg | 36/33 |
| 2,224,590 | 12/1940 | Boivin | 36/3 |
| 2,343,700 | 3/1944 | Pickens et al. | 36/30 R |
| 2,345,831 | 4/1944 | Pierson | 36/30 R |
| 2,367,808 | 1/1945 | Starner | 36/30 |
| 2,379,139 | 6/1945 | Flink | 36/19.5 |
| 2,401,088 | 5/1946 | Lumbard | 36/30 |
| 2,405,224 | 8/1946 | Margolin | 36/30 R |
| 2,411,479 | 11/1946 | Tarlow | 12/142 |
| 2,508,392 | 5/1950 | Issazy | 36/30 R |
| 2,547,480 | 4/1951 | McDaniel | 36/19 |
| 2,983,056 | 5/1961 | Murawski | 36/29 |
| 3,165,841 | 1/1965 | Rollman | 36/2.5 |
| 3,252,231 | 12/1930 | Gilkerson | 36/28 |
| 3,384,046 | 9/1974 | Fowler | 36/28 |
| 4,059,910 | 11/1977 | Bryden et al. | 36/11.5 |
| 4,377,041 | 3/1983 | Alchermes | 36/30 R |
| 4,476,638 | 10/1984 | Quacquarini et al. | 36/11.5 |
| 4,494,322 | 1/1985 | Klagmann | 36/28 |
| 4,561,195 | 12/1985 | Onoda | 36/30 R |
| 4,603,698 | 8/1986 | Guttmann | 128/603 |
| 4,608,768 | 9/1986 | Cavanagh | 36/28 |

FOREIGN PATENT DOCUMENTS

| | | | |
|---|---|---|---|
| 75570 | 2/1919 | Austria | 36/33 |
| 77714 | 12/1919 | Austria | 36/33 |
| 79963 | 2/1920 | Austria | 36/33 |
| 515101 | 3/1921 | France | 36/33 |
| 52079 | 8/1943 | France | 36/33 |
| 58-49101 | 3/1983 | Japan . | |
| 46172 | 2/1909 | Switzerland | 36/44 |

*Primary Examiner*—Steven N. Meyers

*Attorney, Agent, or Firm*—Armstrong, Nikaido, Marmelstein & Kubovcik

[57] ABSTRACT

A sole of a shoe provides for limiting the flex of the shoe. The sole includes a flexible portion positioned in the flexing area of the shoe corresponding to the ball of the wearers foot, a generally rigid front plate extending forward from the flexible portion, and a generally rigid rear plate extending rearward from the flexible portion. Further, a flexible banding or strapping layer is provided for underlying the flexible portion and at least part of the front and rear plates. The flexible strapping layer is fixed to the flexible portion and to the plates to maintain the positional relationship therebetween. Further, the flexible portion includes a plurality of generally laterally extending rigid slats. In a cross-sectional view, each of the generally laterally extending rigid slats has a top, a bottom, and opposing side shoulders. The bottom is affixed directly to the strapping layer. At least one of the shoulders is tapered toward the top such that when the flexible portion is flexed, adjacent shoulders of adjacent slats bear upon one another after a predetermined range of flexing, thus limiting any further longitudinal flex of the flexible portion.

16 Claims, 3 Drawing Sheets

FLEX LIMITING SHOE SOLE

BACKGROUND OF THE INVENTION

In an athletic shoe, flexibility is an important quality. Traction is another important quality for increasing the performance of today's athletic shoes. The athletic shoes on the market today must therefore provide good traction and a high degree of flexibility. However, the same degree of traction and flexibility are also responsible for many foot injuries, especially around the toe area. In order to provide protection from foot injury, some current athletic shoes have a strong semi-rigid plastic type sole that provides the additional protection for the foot and toe area in particular, yet it reduces flexibility.

With the increase in flexibility of modern shoes, as well as the increase in traction (for example, from artificial playing surfaces), certain forms of foot injury, commonly referred to as "turf-toe" have been more common among today's athletes. Up to this time, there have been no shoes which enhance the protection of the athletes foot against the "turf toe" injury, while retaining the necessary flexibility to allow the athlete or wearer maximum performance.

The above described "turf-toe" injury may come about due to the hyperextension of the toes. The hyperextension of the toes is caused by the bending of the toes up and back toward the top of the foot past the point of normal activity or flexibility. This injury sometimes occurs when the toe portion of the shoe worn by the athlete has very good traction with respect to the field or playing surface while the rest of the foot still moves forward forcing the hyperextension of the toe (usually the big toe) thus causing injury to the metatarsophalangeal joint. Another type of "turf-toe" injury may be caused when the toe portion of a soft-soled shoe is slammed into the hard playing surface placing all of the impact force on the toe joints. None of the present shoes provide sufficient protection against the above foot injuries while maintaining sufficient flexibility for the necessary performance of the athlete.

SUMMARY OF THE INVENTION

In order to overcome the above cited disadvantages of the present shoes available on the market, the instant invention is provided to maintain the flexibility of the sole of the shoe, yet to provide a limit as to the total range of flexibility therein.

The instant invention provides a sole of a shoe for limiting the flex of the shoe. The sole includes a flexible portion positioned in the flexing area of the shoe corresponding to the ball of the wearers foot, a generally rigid front plate extending forward from the flexible portion, and a generally rigid rear plate extending rearward from the flexible portion. Further, a flexible banding or strapping layer is provided for underlying the flexible portion and at least part of the front and rear plates. The flexible strapping layer is fixed to the flexible portion and to the plates to maintain the positional relationship therebetween. Further, the flexible portion includes a plurality of generally laterally extending rigid slats, wherein the slats include means for limiting the flex of the flexible portion in the longitudinal direction to a predetermined limit.

Specifically, in a cross-sectional view, each of the generally laterally extending rigid slats has a top, a bottom, and opposing side shoulders. The bottom is affixed directly to the strapping layer. At least one of the shoulders is tapered toward the top such that when the flexible portion is flexed, adjacent shoulders of adjacent slats bear upon one another after a predetermined range of flexing, thus limiting any further flex of the flexible portion.

In the non-flexed position, then the rigid slats have generally laterally extending grooves therebetween. The grooves maintain the flexibility in the longitudinal direction of the shoe for maximum performance of the athlete until the sole has flexed to the predetermined point where adjacent shoulders of slats bear upon one another. At this point, the generally laterally positioned rigid slats then prevent the further longitudinal flexing of the shoe, thus preventing the hyperextension of the toes, in order to reduce the "turf-toe" type injuries.

An additional advantage is provided in the instant flex limiting shoe sole. The instant shoe sole can also enhance athletic performance by automatically limiting the amount of flex in the ball portion of the foot to maximize forward thrust. In conventional athletic shoes with flexible soles, the force of the forward thrust is transmitted to the metatarsophalangeal joint. Once the athlete leans forward into a thrusting situation, the instant invention limits flexing to the predetermined angle. Therefore, any additional force from the thrust would be transmitted to the entire foot through the flex limiting sole, and not only to the metatarsophalangeal joint.

Another advantage is that the generally laterally extending rigid slats of the instant invention also help to prevent the traction portion of the shoe from rolling out from under the foot during quick directional changes. Conventional flexible athletic shoe soles can "roll out" laterally on the foot, thus reducing traction and increasing the potential for foot injuries during the above-mentioned quick directional changes.

BRIEF DESCRIPTION OF THE DRAWINGS

The advantages of the invention will become apparent in the following description taken in conjunction with the drawings, wherein.

DETAILED DESCRIPTION OF THE PREFERRED EMBODIMENT

Figure 1:
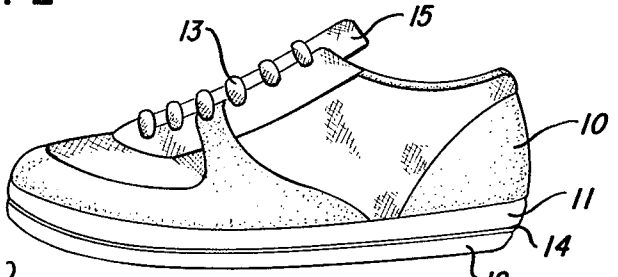
FIG. 1 is a perspective view of an athletic shoe employing the sole of the instant invention.

FIG. 1 illustrates a perspective view of shoe 10 having an inner sole 11 and a traction layer 12. The shoe of FIG. 1, of course, includes laces 13 and a tongue 15 and generally is constructed in a conventional manner. However, the flex limiting sole 14 is shown positioned between inner sole 11 and traction layer 12.

The specific structure of the flex limiting sole 14 will now be described in connection with FIGS. 2 and 3. Flex limiting sole 14 includes a front plate 16 and a rear plate 17. A flexible portion is generally indicated by reference numeral 18. The front plate and rear plate are generally made of a rigid material. In other words, this means a hard material that is generally inflexible and will not compress, similar to a hard plastic, light metal, or composite material. A rearmost portion 19 of the sole can be made out of a pliable material, which would be a semi-soft material that holds thickness and is flexible in all directions, and could be similar to rubber or leather. Additionally, edge portions 20 may also be made out of pliable material.

Front plate 16 is illustrated as extending to the front end of the shoe. This provides protecton from frontal impact on the toe point of the shoe. In the conventional flexible athletic shoes, the shoe absorbs little of the frontal impact with the force generally being absorbed by the toes and the metatarsophalangeal joint. Because the front plate extends to the front of the shoe, such a frontal impact is transmitted to the entire sole of the shoe through the front plate, flexible portion, and rear plate and thus is not entirely absorbed by the toe or the metatarsophalangeal joint.

Figure 3:
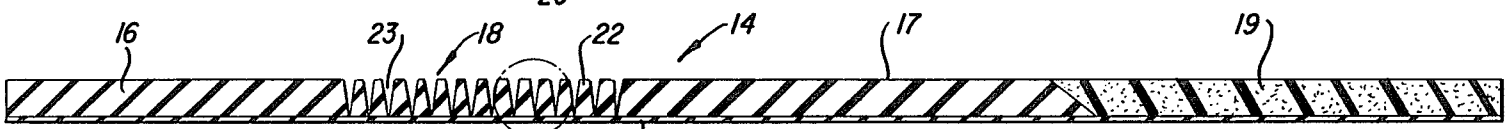
FIG. 3 is a cross-sectional view of the sole along line III—III of FIG. 2.

A strapping layer 21 (as seen in FIG. 3) is bonded to the underside of front plate 16, flexible portion 18, and rear plate 17. The strapping layer may or may not be bonded to rearmost portion 19 depending on construction requirements. The strapping layer 21 therefore holds the front plate, flexible portion, and rear plate in their relative positions with respect to one another. Further, the strapping layer is bonded to the bottom of each slat 22 of flexible portion 18. The strapping layer thus holds each slat 22 in place, as well as providing the tensile strength to limit the longitudinal flex of the flex limiting sole itself. The strapping layer 21 reinforces the back of the flex limiting sole and is permanently bonded to the bottoms of slats 22.

Each of the slats 22 is made of a rigid material, and extends generally laterally across the sole. While the slats 22 extend generally laterally across the shoe, they may be angled slightly in order to accommodate the natural flexing of the shoe and the foot of the wearer. As seen in FIG. 2, the slats 22 are angled slightly from a strict perpendicular relationship with the center line of the shoe sole. Due to the shape of the slats 22, tapered grooves 23 are formed between the slats and therefore also run generally laterally across the shoe sole.

Figure 6:
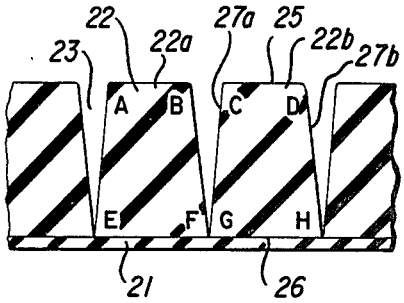
FIG. 6 is an expanded view of the cross-sectional view of FIG. 3 showing the side view of the rigid slats.

FIG. 6 is an enlarged view of the area within 24 in FIG. 3. FIG. 6 thus shows the cross-sectional view of each of the slats 22 and the tapered grooves 23. In FIG. 6, slats 22*a* and 22*b* are shown adjacent one another. For example, on slat 22*b*, top 25, bottom 26, and shoulders 27*a* and 27*b* are shown. Slat 22*a* has corners A, B, E, and F. Slat 22*b* has corners C, D, G, and H. As can be seen in FIG. 6, each of the shoulders 27*a* and 27*b* of slat 22*b* are tapered toward the top 25 in order to form tapered grooves 23 between adjacent slats. It is even possible that only one of the shoulders would be tapered toward top 25.

Figure 5:
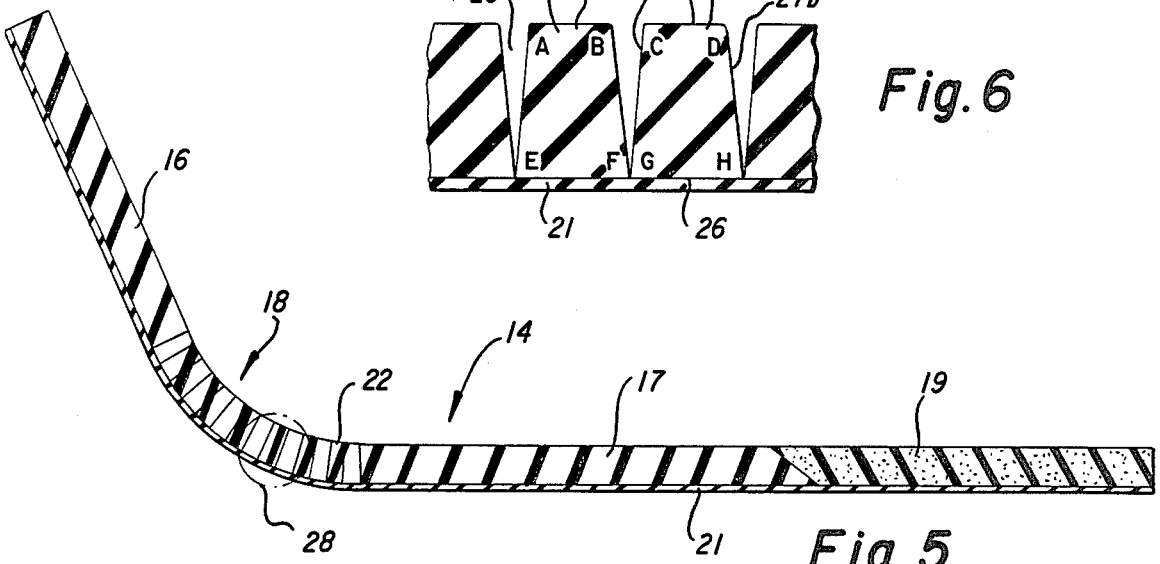
FIG. 5 is a cross-sectional view of the sole of the instant invention similar to FIG. 3, except in the full flexed position.

FIG. 5 shows the cross-sectional view of flex limiting sole 14 in the flexed position. In FIG. 5, all the elements are the same as in FIG. 3. However, in the flexing of the shoe sole, caused by the flexing of the wearers foot, the front plate 16 is flexed upward relative to rear plate 17. The flex is accommodated by flexible portion 18, and strapping layer 21 provides the tensile strength to limit the flex while slats 22, when bearing upon one another in the fully flexed position, provide compression strength for limiting the flex of the sole.

Figure 7:
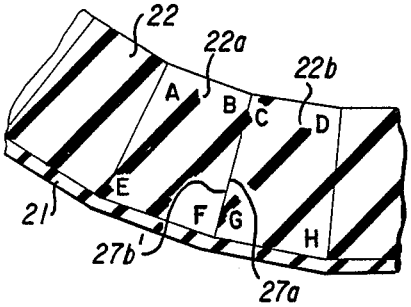
FIG. 7 is an expanded view similar to FIG. 6, wherein the sole is in the flexed position.

FIG. 7 is an enlargement of the area within circle 28 of FIG. 5. As seen in FIG. 7, when the sole is in the fully flexed position, grooves 23 disappear when adjacent slats bear upon one another. Specifically noted, corner B of slat 22*a* now bears directly against corner C of slat 22*b*. Also, corner F of slat 22*a* bears against corner G of slat 22*b*. As can be seen, also, from FIG. 7, the shoulder 27*a* of slat 22*b* bears directly upon shoulder 27*b*′ of slat 22*a*. Thus, when the flex limiting sole is in its fully flexed position, the slats provide the compression strength to limit the flex, as illustrated by shoulder 27*a* bearing against shoulder 27*b*′. Additionally, since the strapping layer 21 is bonded to the bottoms 26 of each slat, this provides tensile strength to maintain the slats in their proper position in order to limit the flexing of the flex limiting sole.

Figure 2:
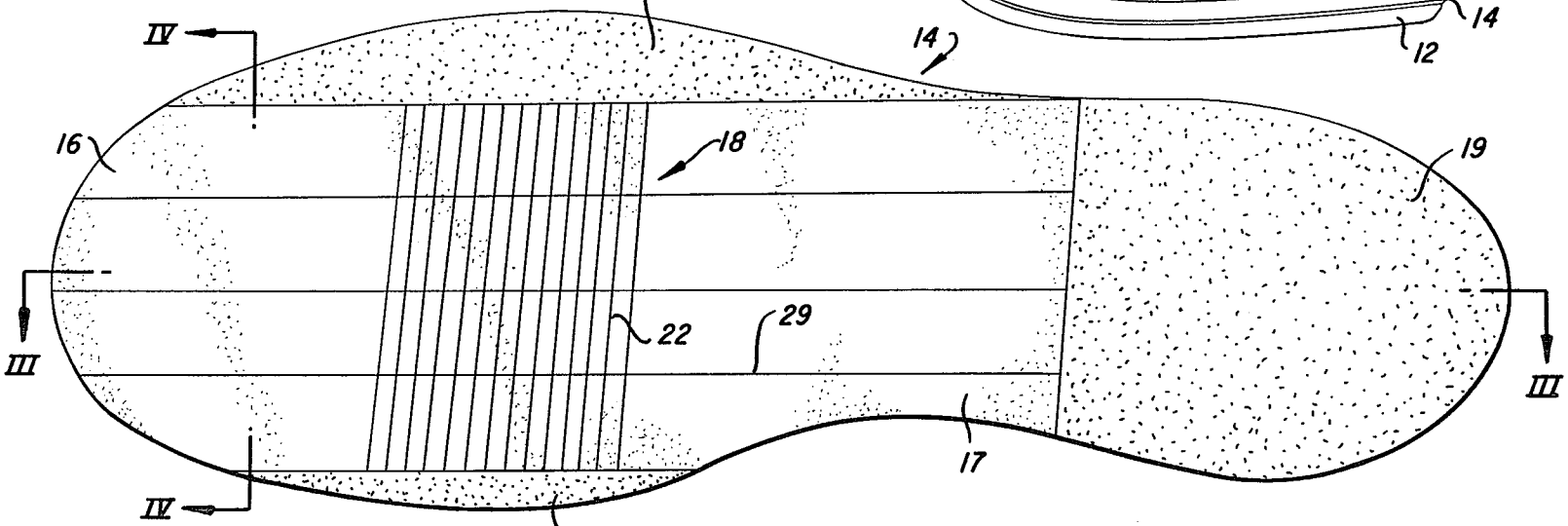
FIG. 2 is a plan view of the sole of the instant invention.
Figure 4:
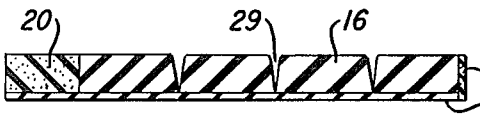
FIG. 4 is a cross-sectional view of the sole of FIG. 2, taken along line IV—IV.

FIG. 4 is a cross-sectional view taken along line IY—IY of FIG. 2. In FIG. 4, flexibility grooves 29 are provided between portions of front plate 16. Strapping layer 21 is shown underlying front plate 16 and edge portions 20 and may or may not be bonded to edge portions 20. Flexibility grooves 29 are seen in FIG. 2 running generally longitudinally with respect to the length of the shoe, and extend into the flexible portion 18 and the rear plate 17. The flexibility gooves 29 are provided only to increase the lateral flexibility of the shoe, and are not intended to limit the lateral flex of the shoe. The flexibility grooves 29 are narrow at the bottom, near the strapping layer 21, and are wide at the top thereof. Thus, the lateral flexing is enhanced, as grooves 29 disappear during lateral flexing of the sole.

Figure 8:
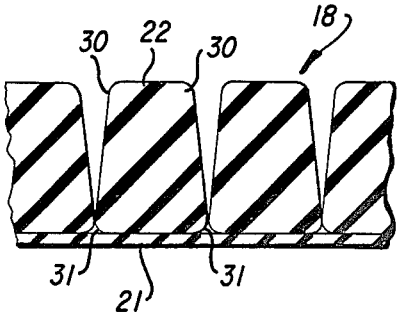
FIG. 8 is an expanded view as in FIG. 6, showing a second embodiment of the slats.

FIG. 8 illustrates a second embodiment of the shape of the slats 22. FIG. 8 is also an enlargement of the area inside circle 24 of FIG. 3. In FIG. 8, each slat 22 has rounded corners 30 on the top portion thereof and rounded corners 31 on the bottom thereof.

Figure 9:
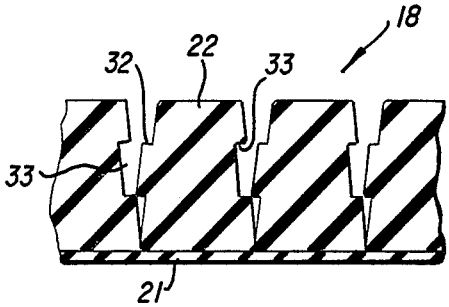
FIG. 9 is also an expanded view, as in FIG. 6, showing a third embodiment of the slats.

FIG. 9 represents a third embodiment of the slats of FIG. 3, as seen in a cross-sectional view. Each slat 22 has a protrustion 32 extending from one shoulder thereof and an indentation 33 formed in the opposite shoulder thereof. During the flexing of the flexible portion 18, each protrusion 32 mates with an indentation 33 on a shoulder of an adjacent slat in order to provide an interlocking structure. Protrusions 32 and indentations 33 may extend the full length of each slat, or may simply be provided on a specified portion of the length of each slat. In which ever case, each protrusion 32 must be able to cooperatively mate with an adjacent indentation 33.

Figure 10:
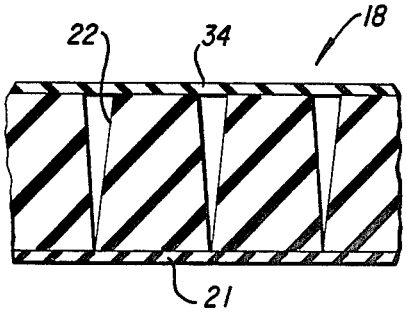
FIG. 10 is an expanded view, as in FIG. 6, showing another embodiment with a protective cover on top of the slats.

FIG. 10 provides a further embodiment of the flex limiting sole, wherein a protective cover 34 is provided on top of slats 22. However, the protective cover 34 is not specifically bonded to the tops of slats 22 in order to allow the necessary flexibility thereof. The protective cover 34 serves the purpose of separating the flex limiting sole from a cushion portion or inner sole of the shoe.

Figure 11:
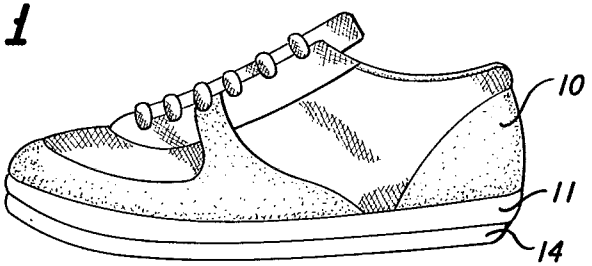
FIG. 11 is a perspective view of an athletic shoe illustrating an alternate construction thereof.

FIG. 11 also shows a perspective view of the shoe 10 with flex limiting sole 14. However, in this figure the flex limiting sole 14 includes the traction layer 12. In this embodiment of the invention, strapping layer 21 also includes the traction layer.

Figure 12:
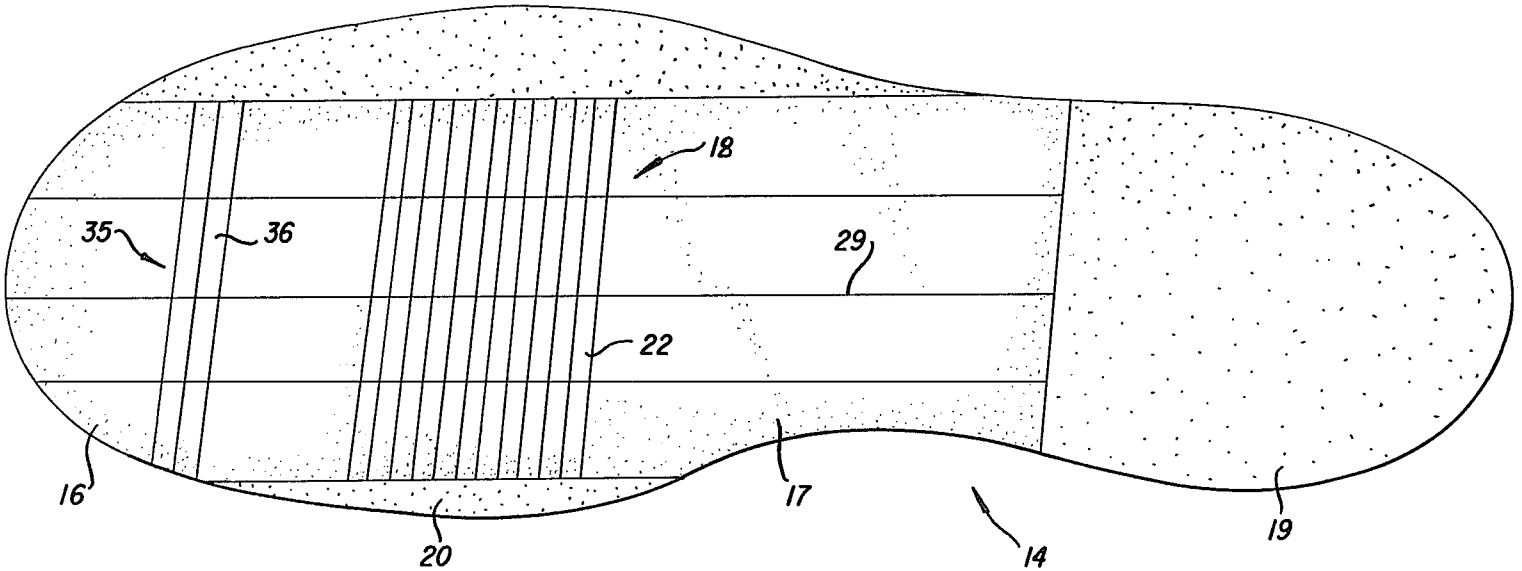
FIG. 12 is a plan view of the sole of the instant invention similar to FIG. 2, yet showing a further embodiment of the invention.

FIG. 12 shows a plan view of another embodiment of the instant invention. The structure of FIG. 12 is similar to that of FIG. 2, and similar elements are indicated by similar reference numerals, such as front plate 16, flexible portion 18, and rear plate 17. However, in FIG. 12, the front plate 16 includes a forward flexible portion 35, having several generally laterally extending front slats 36. The front slats 36 have generally the same structure as the slats 22 of the flexible portion 18 as set forth above. The forward flexible portion 35 may be positioned anywhere in front plate 16. However, for best results in providing a more natural flex for the foot while retaining the same protection, the forward flexible portion is shown in FIG. 12 as positioned in a forward toe section, generally in the middle of front plate 16. As with the flexible portion 18, the shoulders of adjacent front slats 36 bear against one another when flexed in order to limit the flexing of forward flexible portion 35.

Of course, the length of the slats 22 may be varied in accordance with the particular application. The number and size of the tapered grooves and the flexibility grooves, also, may be tailored to the specific application. In fact, each slat may have only one shoulder tapered toward the top and the other shoulder being perpendicular with the top.

Although a specific form of embodiment of the instant invention has been described above and illustrated in the accompanying drawings in order to be more clearly understood, the above description is made by way of example and not as a limitation to the scope of the invention. It is contemplated that various other modifications apparent to one of ordinary skill in the art could be made without departing from the scope of the invention which is to be determined by the following claims.

I claim:

1. A sole of a shoe for limiting the flex of the shoe, comprising:

a flexible portion positioned in a flexing area of the shoe corresponding to the ball of the wearer's foot;

a generally rigid front plate, extending forward from said flexible portion;

a generally rigid rear plate, extending rearward from said flexible portion; and a flexible strapping layer underlying said flexible portion and at least part of said front and rear plates, and fixed to said plates and flexible portion to maintain the positional relationship therebetween and to provide tensile strength from said flexible portion during flexing;

wherein said flexible portion includes a plurality of generally laterally extending rigid slats, each slat having a top, a bottom, and opposing side shoulders in a longitudinal cross-sectional view, and wherein the bottom of each slat is fixed to said strapping layer, and at least one of said shoulders is tapered toward said top, such that when said flexible portion is flexed, adjacent shoulders of adjacent slats bear upon one another after a predetermined range of flexing, thus limiting the flex of said flexible portion in the longitudinal direction to a predetermined limit.

2. The sole of claim 1, wherein said front plate extends all the way to the front of the shoe.

3. The sole of claim 1, wherein both shoulders of each slat are tapered toward the top thereof.

4. The sole of claim 1, wherein said slats have rounded corners when viewed from said longitudinal cross-sectional view.

5. The sole of claim 1, wherein each slat has a protrusion on one shoulder, and an indentation on the opposing shoulder thereof, such that when adjacent shoulders bear upon one another at the flex limit, a protrusion from one shoulder mates with an indentation from an adjacent shoulder.

6. The sole of claim 1, wherein a protective cover is disposed on top of said slats.

7. The sole of claim 1, wherein said sole is positioned between an inner sole and a traction layer.

8. The sole of claim 1, wherein said strapping layer comprises the traction layer of the shoe.

9. The sole of claim 1, wherein the length of each of said slats is the same as the width of said front plate.

10. The sole of claim 1, wherein said rear plate extends only part of the way to the rear of the shoe, and an end layer of pliable material extends from the end of said rear plate to the rear end of the shoe.

11. The sole of claim 1, wherein said sole includes flexibility grooves positioned generally longitudinally with respect to said sole.

12. The sole of claim 11, wherein said front plate, said flexible portion and said rear plate, all include said longitudinal flexibility grooves, wherein the grooves are narrow at the bottom thereof and wide at the top such that upon lateral flexing of the sole, said grooves disappear, thus increasing the lateral flexibility of the sole.

13. The sole of claim 1, wherein said generally rigid front plate includes a forward flexible portion including several generally laterally extending rigid front slats, and wherein said front slats include a limiting means for limiting the flex of said forward flexible portion in the longitudinal direction to a predetermined limit.

14. The sole of claim 13, wherein said limiting means comprises said several front slats wherein each front slat has a top, a bottom, and opposing side shoulders in a longitudinal cross-sectional view, and wherein the bottom of each front slat is fixed to said strapping layer, and at least one of said shoulders is tapered toward said top, such that when said forward flexible portion is flexed, adjacent shoulders bear against one another to limit the flex thereof.

15. The sole of claim 1, wherein said shoe is an athletic shoe.

16. The sole of claim 1, wherein the widest portion of each slat, when viewed in a longitudinal cross-section, is substantially at the bottom of the slat, where the slat is fixed to said strapping layer.

* * * * *